US009963202B2

(12) United States Patent
Bullmer et al.

(10) Patent No.: US 9,963,202 B2
(45) Date of Patent: May 8, 2018

(54) MULTI-HULLED VESSEL HAVING A COMPENSATING CONNECTION FOR REDUCING BEARING LOAD

(71) Applicant: FUTURA YACHT SYSTEMS EUB GMBH & CO. KG, Wannweil (DE)

(72) Inventors: Ernst Bullmer, Seeshaupt (DE); Gerhard Euchenhofer, Wannweil (DE)

(73) Assignee: FUTURA Yacht Systems EuB GmbH & Co. KG, Wannweil (DE)

( * ) Notice: Subject to any disclaimer, the term of this patent is extended or adjusted under 35 U.S.C. 154(b) by 0 days. days.

(21) Appl. No.: 15/123,584

(22) PCT Filed: Mar. 3, 2015

(86) PCT No.: PCT/EP2015/000481
§ 371 (c)(1),
(2) Date: Sep. 2, 2016

(87) PCT Pub. No.: WO2015/131999
PCT Pub. Date: Sep. 11, 2015

(65) Prior Publication Data

US 2017/0073044 A1 Mar. 16, 2017

Related U.S. Application Data

(60) Provisional application No. 61/946,991, filed on Mar. 3, 2014.

(30) Foreign Application Priority Data

Mar. 3, 2014 (EP) ..... 14000753

(51) Int. Cl.
*B63B 1/00* (2006.01)
*B63B 1/14* (2006.01)

(52) U.S. Cl.
CPC ..... *B63B 1/14* (2013.01); *B63B 2001/145* (2013.01)

(58) Field of Classification Search
CPC ..... B63B 1/14
See application file for complete search history.

(56) References Cited

U.S. PATENT DOCUMENTS 2,495,190 A 1/1950 Stewart
2,584,122 A 2/1952 Gilmore
(Continued)

FOREIGN PATENT DOCUMENTS

DE 3835551 A1 4/1990
DE 19963423 A1 7/2001
(Continued)

OTHER PUBLICATIONS

International Search Report dated Mar. 3, 2015 issued in PCT/EP2015/000481.

*Primary Examiner* — Stephen P Avila
(74) *Attorney, Agent, or Firm* — Morris & Kamlay LLP

(57) ABSTRACT

A multi-hull vessel having a first hull and a second hull. The multi-hull vessel has a connecting structure, via which the first hull is connected to the second hull. The connecting structure has a displacement bearing for partially guiding a change of a position of the first hull relative to the second hull. The connecting structure is configured so that the displacement bearing is connected to the first hull via a compensating connection. The compensating connection has one or more degrees of freedom for reducing a bearing load of the displacement bearing.

25 Claims, 9 Drawing Sheets

(56) References Cited

U.S. PATENT DOCUMENTS

| | | | | |
|---|---|---|---|---|
| 4,441,445 | A * | 4/1984 | De Weck | B63C 7/003 114/123 |
| 4,494,472 | A | 1/1985 | Rougerie | |
| 4,716,847 | A | 1/1988 | Wilson | |
| 5,277,142 | A * | 1/1994 | Connor | B63B 1/14 114/283 |
| 5,515,801 | A | 5/1996 | Fortin et al. | |
| 5,642,682 | A | 7/1997 | Pierce | |
| 6,089,173 | A | 7/2000 | Landé | |
| 6,386,130 | B1 | 5/2002 | Kuehne | |
| 6,433,875 | B1 * | 8/2002 | Kovac | B25J 9/1692 33/707 |
| 6,990,915 | B2 * | 1/2006 | Smith | B63B 1/14 114/61.16 |
| 2010/0000454 | A1 | 1/2010 | Grenestedt | |

FOREIGN PATENT DOCUMENTS

| | | | |
|---|---|---|---|
| EP | 2298637 | A1 | 3/2011 |
| FR | 816158 | A | 8/1937 |
| FR | 2808251 | A1 | 11/2001 |
| FR | 2964940 | A1 | 3/2012 |
| GB | 2385563 | A | 8/2003 |

* cited by examiner

MULTI-HULLED VESSEL HAVING A COMPENSATING CONNECTION FOR REDUCING BEARING LOAD

CROSS-REFERENCES TO RELATED APPLICATIONS

The present application claims priority to and the benefit of European Patent Application No. 14 000 753.5 filed Mar. 3, 2014, the entire contents of which are hereby incorporated by reference herein. Further, the present application claims priority and the benefit of U.S. Provisional Application Ser. No. 61/946,991, filed Mar. 3, 2014, the entire contents of which are hereby incorporated by reference herein.

FIELD OF THE INVENTION

The present invention relates to multi-hull vessels such as catamarans and trimarans. In particular, the present invention relates to a multi-hull vessel, having a variable width.

RELATED ARTS

Catamarans and trimarans are known from prior art. Such multi-hull vessels have advantages over single-hull vessels. Compared to single-hull vessels, for multi-hull vessels, the required stability under wind pressure is achieved through a comparatively large width of the vessel. For single-hull vessels, which, in comparison to multi-hull vessels, have a small width, the stability under wind pressure is achieved through a large keel ballast. The fact that multi-hull vessels do not require keel ballast, has, inter alia, the consequence that multi-hull vessels, if suitably constructed, are deemed as unsinkable.

Multi-hull vessels which have been developed so far typically have a fixed width. The hulls are often configured so that they can be used for cabin purposes.

However, a disadvantage of these conventional multi-hull vessels resides in that they can not—or only in a limited way—use the conventional maritime infrastructure in marinas, since the conventional maritime infrastructure is tailored to single-hull vessels, which have a small width. This applies to berths, as well as to crane facilities, winter berths ashore and lock facilities on inland waterway systems.

For this reason, catamarans were proposed, which have a variable width.

However, it has been shown that the mechanical device designated for varying the width of the multi-hull vessel is susceptible to failure and is subjected to increased wear.

Accordingly, there is a need for multi-hull vessels, which have a reliable device for varying the position and/or orientation of the hulls relative to each other.

Embodiments provide a multi-hull vessel, comprising a first hull and a second hull. The multi-hull vessel may include a connecting structure, via which the first hull is connected to the second hull. The connecting structure may include a displacement bearing for at least partially guiding a change of a position and/or an orientation of the first hull relative to the second hull. The connecting structure may be configured so that the displacement bearing is connected to at least a portion of the first hull via at least one compensating connection. The compensating connection may include one or more degrees of freedom for reducing a bearing load of the displacement bearing.

According to an embodiment, the multi-hull vessel comprises one or more drive systems for the changing the position and/or the orientation of the first hull relative to the second hull. Through the changing of the position and/or the orientation, a distance between the first hull and the second hull may be variable. Through the changing of the distance, a width of the multi-hull vessel may be variable. Each of the drive systems may be manual and/or motorized.

The multi-hull vessel may be configured so that a distance between the first and the second hull is variable. The distance may be measured along a direction perpendicular to a central axis and/or perpendicular to a direction of travel of the multi-hull vessel. The central axis may extent along or may substantially extent along the direction of travel of the multi-hull vessel and/or parallel to a longitudinal axis of the first and/or the second hull. The multi-hull vessel may be configured to have a variable width. The longitudinal axis of the first hull may always, or at least during the variation of the distance, oriented parallel or substantial parallel to the longitudinal axis of the second hull. The longitudinal axis of the first hull and/or the longitudinal axis of the second hull may extent along or may substantially extent along the direction of travel.

The expression "displacement bearing" may be defined as a bearing which is used for guiding the change of the position and/or the orientation of the first hull relative to the second hull. The displacement bearing may be configured to at least partially guide a movement of components of the connecting structure relative to each other. The connecting structure may be configured so that by means of the relative movement of the components, the change of the position and/or the orientation of the first hull relative to the second hull is effected. In this context, the expression "partially" may be defined to mean that the connecting structure has further bearings which also partially guide the movement of the components relative to each other. By way of example, the connecting structure may be configured so that the displacement bearing at least partially guides the movement of a force-transmitting component of the connecting structure relative to a load-supporting structure of the connecting structure. A force-transmitting component may be for example a beam. The force-transmitting component may be configured to be rigid. At a transition between the force-transmitting component and the first hull, the compensating connection may be arranged.

Thereby, a multi-hull vessel is provided, which has a reliable device for changing the position and/or the orientation of the hulls relative to each other. In particular, thereby, it is possible to ensure longevity of the displacement bearing and to prevent bearing failures.

By way of example, the multi-hull vessel may be a catamaran or a trimaran. The first and/or the second hull may be configured to be rigid.

The connecting structure may include one or more force-transmitting components. Each of the one or more force-transmitting components may be configured to be rigid and/or have a longitudinal shape, which extends along a longitudinal axis of the force-transmitting component. A force-transmitting component may for example be configured as a beam. Each of the one or more force-transmitting components may be configured for a force transmission to the first or the second hull for changing the position and/or the orientation of the first hull relative to the second hull. The force may be transmitted along or substantially along the longitudinal axis of the force-transmitting component. By way of example, the force may be transmitted along or substantially along an axial direction of the beam.

By way of example, the connecting structure may include four force-transmitting components, wherein two of the force-transmitting components are configured for a force transmission to the first hull and the two further force-transmitting components are configured for a force transmission to the second hull. The multi-hull vessel may include a load-supporting structure. Each of the force-transmitting components may be connected to the load-supporting structure via a movable connection. A movable connection may include a bearing. The bearing may be a linear bearing.

The compensating connection may be arranged at a transition between the connecting structure and the hull. In particular, the compensating connection may be arranged at a transition between a force-transmitting component and the hull to which the force is transmitted by the force-transmitting component. A first component of the compensating connection may be rigidly connected to the connecting structure or may be formed integrally with at least a portion of the connecting structure. In particular, the first component of the compensating connection may rigidly connected to the force-transmitting component or may be formed integrally with at least a portion of the force-transmitting component. Alternatively or additionally, the first component of the compensating connection may be rigidly connected to the displacement bearing or may be formed integrally with at least a portion of the displacement bearing. Alternatively or additionally, a second component of the compensating connection may be rigidly connected to the first hull or may be formed integrally with at least a portion of the first hull. The first and/or the second component may be configured to be rigid. In this context, the term "rigidly connected", when used in relation to two bodies, may be defined to mean that at least a portion of the first body is abuttingly and non-movably connected to at least a portion of the second body. The first and the second components may be movable relative to each other in a direction along a translational degree of freedom or in a direction parallel to a translational degree of freedom of the compensating connection. Additionally or alternatively, the first and the second components may be swingable relative to each other about a rotational axis of a rotational degree of freedom of the compensating connection. Alternatively, the compensating connection may be a portion of the connecting structure and/or a portion of the hull. By way of example, the compensating connection may be arranged between two components of the connecting structure or between two components of the hull.

Each of one or more of the force-transmitting components may undergo together with the hull to which the force transmission by the respective force-transmitting component is performed, a same or substantially a same change of the position and/or the orientation. In this context, the expression "substantially" may be defined to mean that a relative movement between the force-transmitting component and the hull is neglected which is allowed by the degree of freedom or which is allowed by the degrees of freedom of the compensating connection.

The connecting structure may include a load-supporting structure or may be connected to a load-supporting structure. The load-supporting structure may be configured to carry a transportation load. The transportation load may include a changing, non-permanent load of the vessel, such as passengers and/or baggage. The load-supporting structure may include a living gondola or may be configured to support a living gondola. The living gondola may include a living and/or day area for the passengers. Additionally or alternatively, the load-supporting structure may support at least one sailing mast. At least one or all of the force-transmitting components may be connected to the load-supporting structure. Alternatively, at least a portion of the respective force-transmitting component may be integrally formed with at least a portion of the load-supporting structure. The force-transmitting components may transmit at least a portion of the vertical load of the load-supporting structure and/or of the transportation load. The connection between the load-supporting structure and the force-transmitting component may be a movable connection. The movable connection may include a bearing. The bearing may be a linear bearing. The bearing may be the displacement bearing which at least partially guides the change of the position and/or the orientation of the first hull relative to the second hull. Additionally or alternatively, the connection between the load-supporting structure and the force-transmitting component may be a resilient connection. Additionally or alternatively, the connection may include a resilient connection element. The resilient connection element may be, for example, an elastomeric connection element.

The load-supporting structure may be configured to be torsionally stiff, substantially torsionally stiff, rigid or substantially rigid. The load-supporting structure may, for example, include a plate or a platform.

A compensating connection may be defined as a connection which has at least one degree of freedom. The degrees of freedom of the compensating connection may be translational and/or rotational. One or more or all of the degrees of freedom of the compensating connection may be guided. In other words, the compensating connection may include one or more bearings which are configured so that components of the compensating connection perform a controlled movement relative to each other corresponding to the guided degrees of freedom. The compensating connection may be configured to fix one or more translational degrees of freedom. Additionally or alternatively, the compensating connecting may fix one or more rotational degrees of freedom. The fixed degrees of freedom may be those, which are not provided by the compensating connection. In other words, the compensating connection may be configured not to allow translational or rotational relative movement of components of the compensating connection relative to each other corresponding to the fixed degrees of freedom.

Corresponding features may apply to the connection between the connecting structure and the second hull. In particular, the displacement bearing and/or a further displacement bearing of the connecting structure may be connected to at least a portion of the second hull via at least a further compensating connection.

The compensating connection may include one or more degrees of freedom. The one degree of freedom or the plurality of degrees of freedom of the compensating connection may be configured so that a bearing load of the displacement bearing is reduced. The bearing load may be a force which is oriented substantially perpendicular to a degree of freedom or to a direction of motion of the displacement bearing. By way of example, the bearing load of a linear bearing may be oriented substantially perpendicular to the guide direction of the linear guide. A bearing load of a radial bearing may be oriented substantially in a radial direction. The bearing load may occur during the change of the position and/or orientation of the first hull relative to the second hull.

The compensating connection may have a single joint or a plurality of joints. A joint may be defined as a moveable connection between two rigid portions. The compensating connection may be rigidly connected to at least a portion of the hull, the connecting structure and/or the displacement bearing. The compensating connection may be rigidly connected to the displacement bearing and/or may be rigidly connected to the first hull.

The displacement bearing may include a linear bearing or may consist of one or more linear bearings.

According to an embodiment, the compensating connection is configured to transmit at least a portion of a force for changing the position and/or the orientation of the first hull relative to the second hull. The compensating connection may block or fix at least those degrees of freedom, which are used for transmitting the portion of the force. The compensating connection may be configured so that the compensating connection has no translational degrees of freedom along one or more directions along which the force is transmitted. Additionally or alternatively, the compensating connection may be configured so that the compensating connection does not allow translational movements of components of the compensating connection relative to each other along one or more directions, along which the force is transmitted.

By way of example, all translational degrees of freedom of the compensating connection are oriented substantially perpendicular to the direction of force transmission. The blocked or fixed degrees of freedom may be complementary to the degrees of freedom, which are provided by the compensating connection.

According to an embodiment, the degree of freedom or the degrees of freedom of the compensating connection are not involved or substantially not involved in the changing of the position and/or the orientation of the first hull relative to the second hull. In other words, for the changing of the position and/or the orientation of the hulls, no or substantially no relative movement of the compensating connection may be required along the degrees of freedom of the compensating connection.

According to an embodiment, the compensating connection includes a non-locating bearing and/or a resilient connection element. The resilient connection element may be, for example, an elastomeric connection element. A non-locating bearing may be defined as a bearing, which fixes at least one degree of freedom and has at least one non-fixed degree of freedom. The non-locating bearing may fix one or two translational degrees of freedom. The non-locating bearing may provide exactly one, exactly two or exactly three translational degrees of freedom. Alternatively or additionally, the non-locating bearing may fix exactly one, exactly two or exactly three rotational degrees of freedom. The non-locating bearing may provide exactly one, exactly two or exactly three rotational degrees of freedom. The non-locating bearing may be a linear bearing. The linear bearing may be for example a slide bearing and/or a linear roller bearing.

According to a further embodiment, at least one of the degrees of freedom of the compensating connection is a translational degree of freedom. The translational degree of freedom may be the only degree of freedom or the only translational degree of freedom of the compensating connection. Additionally, the compensating connection may provide exactly one, exactly two or exactly three rotational degrees of freedom.

According to a further embodiment, a translational degree of freedom of the compensating connection is oriented parallel or substantially parallel to a longitudinal axis of the first hull.

According to a further embodiment, an angle between the translational degree of freedom and an axis, which is parallel to the longitudinal axis of the first hull, is less than 60 degrees, less than 45 degrees, or less than 30 degrees, or less than 20 degrees, or less than 10 degrees, or less than 5 degrees.

According to a further embodiment, a rotational axis of a rotational degree of freedom of the compensating connection is oriented parallel or substantially parallel to a longitudinal axis of the first hull. According to a further embodiment, an angle between the rotational axis and an axis which is parallel to the longitudinal axis of the first hull, is less than 60 degrees, less than 45 degrees, or less than 30 degrees, or less than 20 degrees, or less than 10 degrees, or less than 5 degrees.

According to a further embodiment, the compensating connection includes a translational degree of freedom and a rotational degree of freedom, wherein an angle between the translational degree of freedom and an axis, which is parallel to a rotational axis of the rotational degree of freedom, is less than 60 degrees, less than 45 degrees, or less than 30 degrees, or less than 20 degrees, or less than 10 degrees, or less than 5 degrees. According to a further embodiment, the translational degree of freedom is parallel or substantial parallel to the rotational axis.

According to a further embodiment, the compensating connection is configured to compensate for differences in expansion between components of the multi-hull vessel.

The components may be, for example, the first hull, the second hull, the connecting structure and/or the load-supporting structure. The expansion may be a thermal expansion. In particular, the compensating connection may be configured to compensate for a difference in expansion between the first and/or the second hull on one hand and a further component of the multi-hull vessel on the other hand, such as, for example, the connecting structure. The expansion of the first and/or second hull may be, for example, an expansion along the longitudinal axis of the respective hull.

Additionally or alternatively, the compensating connection may be configured to compensate for a changing mechanical load. The changing mechanical load may be caused by wave movements. By way of example, the changing mechanical load may lead to a torsion of the multi-hull vessel.

According to a further embodiment, the connecting structure, a force-transmitting component, the displacement bearing and/or a further displacement bearing of the connecting structure is connected to the first hull via a fixing connection. The fixing connection may be configured so that a least all translational degrees of freedom of the fixing connection are fixed. In other words, the fixing connection has no degrees of freedom or only rotational degrees of freedom. The fixing connection may either be configured so that it has no degree of freedom or configured so that its degrees of freedom are limited to one or more rotational degrees of freedom. The connecting structure, a force-transmitting component, the displacement bearing, the further displacement bearing and/or the first hull may each be rigidly connected to the fixing connection. The fixing connection may include a first and a second component. The first and/or second component may be configured to be rigid. The first component of the fixing connection may be rigidly connected to the connecting structure or may be integrally formed with at least a portion of the connecting structure. The first component may be rigidly connected to a force-transmitting component or may be rigidly formed with at least a portion of the force-transmitting component. The force-transmitting component may be configured for a force transmission to the first hull via the fixing connection. The second component may be rigidly connected to the first hull or may be integrally formed with at least a portion of the first hull. The first and the second components may be swingable relative to each other about a rotational axis of a rotational degree of freedom of the fixing connection. Additionally, the first and the second components may be movable relative to each other in a direction along a translational degree of freedom or parallel to a translational degree of freedom of the compensating connection.

The further displacement bearing may be configured to at least partially guide the change of the position and/or the orientation of the first hull relative to the second hull. A vertical load of the load-supporting structure and/or the transportation load may be at least partially transmitted via the further displacement bearing and/or via the fixing connection.

By way of example, the fixing connection may include one or more locating bearings or may be configured to be a rigid connection. A locating bearing may be defined as a connection, which fixes all three translational degrees of freedom, wherein, however, no torque is transmitted. A rigid connection may be defined as a connection, which fixes all six degrees of freedom. The fixing connection may be configured to transmit at least a portion of the force for varying the position and/or the orientation of first hull relative to the second hull.

According to an embodiment, an axial separation is provided between the compensating connection and the fixing connection, measured along a longitudinal axis of the first hull. According to a further embodiment, an axial separation is provided between all compensating connections and all fixing connections, each of which connecting the connecting structure to the first hull.

By way of example, the axial separation may be greater than one-tenth, greater than one-fourth, greater than one-third, or greater than one-half the axial length of the first hull. All compensating connections may be arranged at the first hull on the stem side relative to all fixing connections or on the stern side relative to all fixing connections.

According to an embodiment, the multi-hull vessel includes a support device for an activatable mechanical bypass of the displacement bearing. The support device may be configured to at least partially support a bearing load of the displacement bearing.

According to a further embodiment, the activation of the mechanical bypass is performed depending on the position and/or the orientation of the first hull relative to the second hull.

The support device may include one or more bolts. The bolt may be arranged at a first component. An opening, which is configured to receive the bolt, may be arranged at a second component. The activation of the support device may be performed by engaging the bolt in the opening. The first component may be connected to the second component via the displacement bearing.

According to a further embodiment, at least one of the degrees of freedom of the compensating connection is configured to allow for a relative movement of more than 5 mm, or more than 10 mm, or more than 50 mm, or more than 100 mm, or more than 200 mm. The compensating connection may be configured so that the allowed relative movement is smaller than 300 mm, or smaller than 200 mm, or smaller than 100 mm. The relative movement may be a pure translatory movement and/or a combined translatory and rotational movement.

The relative movement may be measured between components of the compensating connection, which move relative to one another in a direction along the degree of freedom or in a direction parallel to the degree of freedom. The degree of freedom may be a translational degree of freedom. A first component may be rigidly connected to the connecting structure, in particular rigidly connected to the force-transmitting component. Alternatively, the first component may be formed integrally with at least a portion of the connecting structure, in particular integrally with at least a portion of the force-transmitting component. The second component may be rigidly connected to the first hull. Alternatively, the second component may be integrally formed with at least a portion of the first hull. By way of example, the relative movement may be a movement of a first bearing element relative to a second bearing element. The first and the second bearing elements may be configured as complimentary bearing elements. The first bearing element may be a slide element of a linear bearing, the second bearing element may be a rail of the linear bearing. The relative movement may be guided by the compensating connection. By way of example, the relative movement may be guided by a linear bearing of the compensating connection.

According to a further embodiment, the multi-hull vessel includes a load-supporting structure for carrying a transportation load. A vertical load of the load-supporting structure and/or the transportation load may be at least partially transmitted via the displacement bearing. The transportation load may include a changing load of the vessel, such as passengers and/or baggage.

Additionally or alternatively, the vertical load of the load-supporting structure and/or the transportation load may be at least partially transmitted via the compensating connection and/or via the fixing connection.

Additionally or alternatively, the vertical load of the load-supporting structure and/or the transportation load may be at least partially transmitted via a force-transmitting component. The force-transmitting component may be connected to at least a portion of the first hull via the compensating connection. Alternatively or additionally, the force-transmitting component may be connected to the load-supporting structure via the displacement bearing.

According to a further embodiment, the compensating connection includes a linear bearing. Additionally, the compensating connection may include a radial bearing. The compensating connection may consist of a linear bearing and a radial bearing. The linear bearing may consist of a first and a second bearing element, which are movable relative to each other along the translational degree of freedom of the linear bearing. The first and the second bearing element may be complementary bearing elements of the linear bearing. Additionally, the first and/or the second bearing elements may be configured as complimentary bearing elements of the radial bearing. Additionally, the first and the second bearing element may be swingable relative to each other. The first and/or the second bearing element may be configured to be rigid. The first bearing element may slidingly engage the second bearing element and/or may engage the second bearing element via rollers. By way of example, the first bearing element may be configured as a shaft of the radial bearing. The second bearing element may be configured as a bearing housing of the radial bearing. The bearing housing may at least partially surround the shaft. The bearing housing may be open or closed. The bearing housing may be displaceable along the shaft in an axial direction of the shaft and may be swingable about the shaft. Thereby, a translational degree of freedom of the compensating connection may extend along the shaft of the radial bearing and a longitudinal axis of the shaft may be a rotational axis of a rotational degree of freedom.

According to a further embodiment, the multi-hull vessel includes a measurement device which is configured to acquire a position parameter and/or a movement parameter of the position and/or the orientation of the first hull relative to the second hull.

A position parameter and may be, for example, a distance between the first hull and the second hull. The distance may be measured perpendicular to a central axis of the multi-hull vessel. A movement parameter may be, for example, a rate of change of the position parameter, such as, for example, the rate of the change of the distance.

By way of example, the measurement device includes a laser and/or a measurement wire. The measurement wire may be, for example, extended along a path, which is to be measured.

The changing of the position and/or the orientation of the first hull relative to the second hull may be performed automatically, in particular without limiting or regulating intervention of operating personnel.

The multi-hull vessel may include one or more drive systems for changing the position and/or the orientation of the first hull relative to the second hull. The drive system may be, for example, a manual, hydraulic, electric and/or pneumatic drive system.

According to a further embodiment, the multi-hull vessel is configured so that the change of the position and/or the orientation of the first hull relative to the second hull is controlled depending on the position parameter and/or the movement parameter which are acquired by the measurement device. The multi-hull vessel may include a controller, which is configured to control one or more drive systems for changing the position and/or the orientation of the first hull relative to the second hull.

The controlling of the change of the position and/or the orientation of the first hull relative to the second hull may be configured so that along the trajectory of the change of the position and/or the orientation, the relative positions and/or orientations of the hulls reduce the bearing load of the displacement bearing.

According to an embodiment, the compensating connection includes a swingable connection, which includes a first and a second connection element. The swingable connection may be configured for swinging the first connection element relative to the second connection element. The swingable connection may be configured to provide one or more rotational of degrees of freedom of the compensating connection.

According to a further embodiment, the first connection element is connected in a rigid or torsionally stiff manner to the first hull. Alternatively, the first connection element may be formed integrally with at least a portion of the first hull. Alternatively or additionally, the second connection element may be connected in a rigid or in a torsionally stiff manner to the connecting structure. Alternatively, the second connection element may be integrally formed with at least a portion of the connecting structure. In particular, the second connection element may be connected to the force-transmitting component in a rigid or a torsionally stiff manner. Alternatively, the second connection element may be integrally formed with at least a portion of the force-transmitting component. The force-transmitting component may be configured for a forced transmission to the first hull via the compensating connection. The compensating connection may include a translational degree of freedom for translationally displacing the first connection element relative to the second connection element.

The swingable connection may be configured for a guided swinging of the first connection element relative of the second connection element. The swinging may change an orientation of the first connection element relative to the second connection element. The swingable connection may include a convex surface and a concave surface. The convex surface may engage the concave surface. The convex surface may be in sliding contact with the concave surface. Alternatively, each of the convex and the concave surface may be configured as a raceway surface for rollers of the compensating connection. The convex surface may engage with the concave surface via rollers of the compensating connection. The swinging connection may include a radial bearing or may consist of a radial bearing. The radial bearing may be configured as a roller bearing and/or a slide bearing. The radial bearing may include a shaft. A raceway surface or a sliding surface of the radial bearing may be integrally formed with at least a portion of the shaft or may be rigidly connected to the shaft. The raceway surface may be configured so that rollers of the roller bearing can roll on the raceway surface. The sliding surface may be configured so that a complementary sliding surface of the sliding bearing is in sliding contact with the sliding surface. The radial bearing may be configured as a non-locating bearing, in particular as an axially non-locating bearing.

According to an embodiment, the radial bearing includes a shaft and a bearing housing. The shaft and the bearing housing may be displaceable relative to each other along a longitudinal axis of the shaft. According to a further embodiment, the displaceability provides a translational degree of freedom of the compensating connection.

According to a further embodiment, the swingable connection is configured so that the first connection element is swingable relative to a second connection element through an angle of at least 1 degree or at least 5 degrees or at least 10 degrees or at least 20 degrees or at least 40 degrees. Additionally or alternatively, the swingable connection may be configured so that the first connection element is swingable relative to the second connection element through an angle of less than 180 degrees, less than 90 degrees, less than 45 degrees, less than 30 degrees, less than 20 degrees or less than 10 degrees. The angle may be measured in a plane, which is perpendicular to a longitudinal axis of the first hull and/or perpendicular to a swing axis of the swingable connection. The swing angle may represent a swinging movement between two extreme swinging positions. The compensating connection may be configured so that the first connection element is swingable relative to the second connection element about a swing axis.

The swing axis may be stationary. Alternatively, the swing axis may be displaced during the swinging movement. The swing axis may be a rotational axis of a rotational degree of freedom. The rotational degree of freedom may be the only rotational degree of freedom of the swingable connection or of the compensating connection.

The multi-hull vessel may be configured so that the above-mentioned features and embodiments may also apply for the second hull or for a plurality of further hulls.

BRIEF DESCRIPTION OF THE DRAWINGS

The forgoing as well as other advantageous features of the disclosure will be more apparent from the following detailed description of exemplary embodiments with reference to the accompanying drawings. It is noted that not all possible embodiments necessarily exhibit all, or any, of the advantages identified herein.

DETAILED DESCRIPTION OF EXEMPLARY EMBODIMENTS

Figure 1:
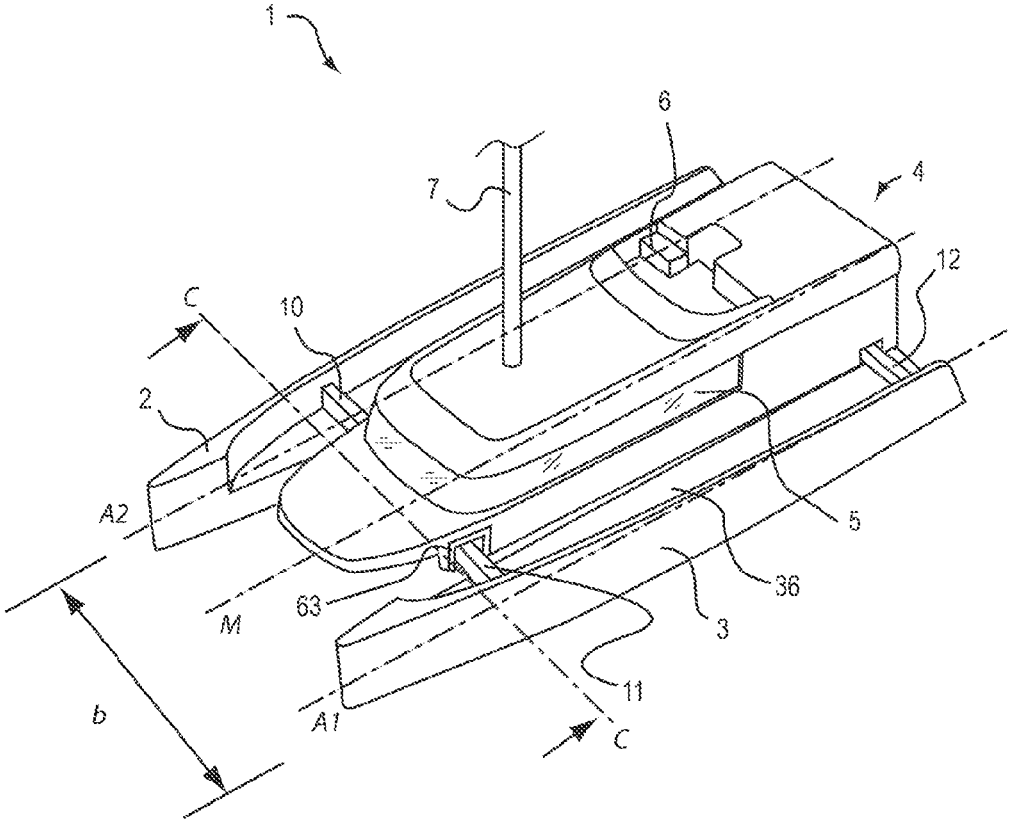
FIG. 1 is as schematic perspective view of a multi-hull vessel according to an embodiment.

FIG. 1 shows a multi-hull vessel 1 according to an embodiment. The multi-hull vessel 1 is configured as a catamaran having a first hull 2 and a second hull 3. However, it is also conceivable that the multi-hull vessel 1 has more than two hulls. In particular, the multi-hull vessel may be alternatively configured as a trimaran.

A load-supporting structure 4 is arranged between both hulls 2, 3. The load-supporting structure 4 is configured to carry a transportation load, such as passengers and baggage. The load-supporting structure 4 includes a living unit having window front. The load-supporting structure 4 further comprises a navigation area 6. On the load-supporting structure 4, a sailing mast 7 is arranged, which, for simplicity of illustration, is only partially shown in FIG. 1.

The hull 2 is connected to the load-supporting structure 4 via the beams 10 and 13 (not shown in FIG. 1); and the hull 3 is connected to the load-supporting structure 4 via the beams 11 and 12. In FIG. 1, only the beams 10, 11 and 12 of the four beams are shown. In the cross-sectional views of FIGS. 2A and 2B, the beams 10 and 11 are shown, and in the top view of FIG. 3 all four beams 10, 11, 12 and 13 are shown.

The beams 10 and 11 are arranged on a stem side relative to the beams 12 and 13. Each of the beams has a longitudinal axis, which is oriented perpendicular to a central axis M of the multi-hull vessel.

Each of the beams 10, 11, 12 and 13 is configured as an I-beam. The beams may be made at least partially of CFRP (Carbon fiber reinforced plastics).

Through a horizontal movement of the beams in a direction, which is oriented substantially perpendicular to the central axis M of the catamaran, the beams 2, 3 are displaceable so that a distance of the hulls from the central axis M is changeable. Thereby, the beams represent force-transmitting components. Each of the beams is configured for a force-transmission to one of the hulls for changing the position of the hulls 2, 3 relative to each other.

Through the changing of the position of the hulls 2, 3 relative to each other, the width b of the catamaran is a variable. The catamaran is configured so that the hulls 2, 3 are simultaneously displaceable. However, it is also conceivable that the hulls 2, 3 are displaceable independently from each other.

Figure 2A:
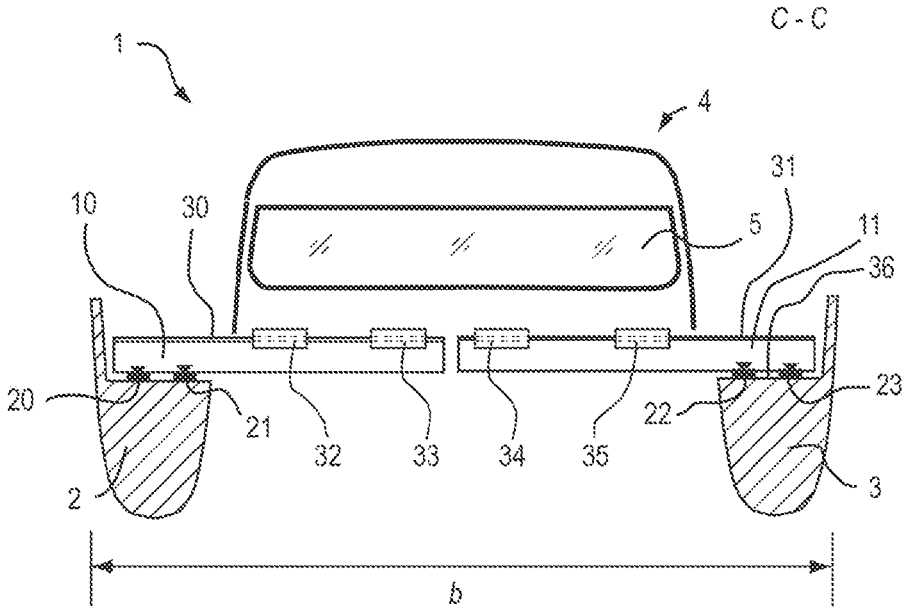
FIG. 2A is that cross-sectional view of the embodiment, which is shown in FIG. 1, taken along the section line, which is shown in FIG. 1, wherein the cross-sectional view shows a first configuration of the multi-hull vessel.
Figure 2B:
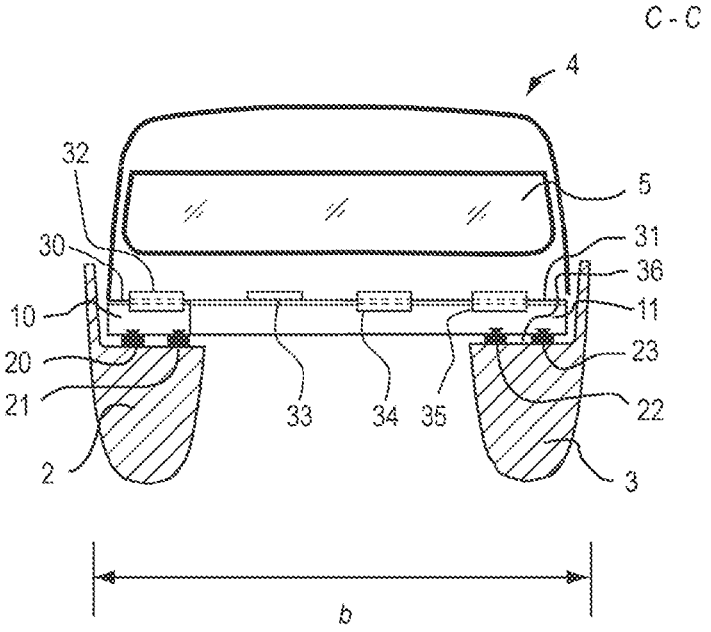
FIG. 2B is a cross-sectional view of the embodiment, which is shown in FIG. 1, taken along the section line, which is shown in FIG. 1, wherein the cross-sectional view shows a second configuration of the multi-hull vessel.

Through the changing of the position of the hulls 2, 3 relative to each other, the catamaran can be converted from a first configuration into a second configuration. FIG. 2A shows the catamaran in the first configuration and FIG. 2B shows the catamaran in the second configuration. Each of these figures shows a cross-sectional view through the catamaran at section line C-C shown in FIG. 1. In the first configuration, the hulls 2, 3 are extended to an extent so that the catamaran has sufficient stability under wind pressure for moving forward using sail power. In the second configuration, the hulls 2, 3 are retracted so that the catamaran can for example be maneuvered into narrow berths and can use lock facilities on inland waterways can be used. Also, in the second configuration, crane facilities and winter berths can be used, which are typically configured for single-hull vessels which have a smaller width b.

The cross-sectional views of FIGS. 2A and 2B schematically illustrate the stem side beams 10 and 11, their connection to the load-supporting structure 4, as well as their connection to the hulls 2, 3. The connection of the stern side beams 12 and 13 to the load-supporting structure 4 is configured analogously to the stem side beams 10 and 11. As will be described with reference to FIG. 3 below, the connection of the stern side beams 12, 13 to the hulls 2, 3 is different from the connection of the stem side beams 10, 11 to the hulls 2, 3.

As viewed in a direction along the central axis of the catamaran, the stem side beams 10 and 11 are arranged displaced relative to each other. Also, as viewed in a direction along the central axis, the stern side beams 12, 13 are arranged displaced relative to each other. Therefore, in FIG. 2B, the beam 10 is partially hidden by the beam 11.

Each of the beams 10, 11, 12, 13 is connected to the load-supporting structure 4 via a linear bearing. Each of the linear bearings transmits a portion of the vertical load of the load-supporting structure 4 and the transportation load which is carried by the load-supporting structure 4. For the beams 10 and 11, the linear bearings are shown in FIGS. 2A and 2B. For the beams 12 and 13, the linear bearings are configured correspondingly.

As is shown in FIGS. 2A and 2B, each of the stem side beams 10, 11 has a linear bearing rail 30, 31, which is attached to the upper side of the respective beam, and which extends substantially along the entire length of the respective beam. On each of the rails 30, 31, two carriages 32, 33, 34 and 35 of the linear bearing travel. Each of the carriages 32, 33, 34 and 35 is connected to the load-supporting structure 4 (not shown in FIGS. 2A and 2B). For each of the carriages 32, 33, 34 and 35, the connection to the load-supporting structure 4 is configured to be moveable. By way of example, the connection between the carriages 32, 33, 34 and 35 and the load-supporting structure 4 includes an elastomeric element and/or configured to be cardanic.

In the illustrated embodiment, for each of the beams, the linear bearings, which connect the respective beam to the load-supporting structure, are configured as linear roller bearings. However, it is also conceivable that the linear bearing is configured as a linear slide bearing.

Each of the linear bearings functions as a displacement bearing. Each of the displacement bearings partially guides the change of the position of the first hull 2 relative to the second hull 3 so that all displacement bearings cooperatively support the positional change. The beams 10, 11, 12 and 13, the displacement bearing and the load-supporting structure 4 cooperatively the function as a connecting structure, which connects the first hull 2 to the second hull 3.

It has been shown that the displacement bearing has a higher wear resistance and that the displacement bearing is more effectively prevented from becoming jammed, if for each of the hulls, a beam is connected to the respective hull via at least one compensating connection. The compensating connection includes at least one degree of freedom which is configured to reduce the bearing load of at least one of the displacement bearings of the catamaran. In the described embodiment, each of the compensating connection is configured as a linear sliding bearing.

By way of example, such a bearing load is caused by different thermal expansions of the first hull, the second hull and/or the load-supporting structure 4. By way of example, depending on the temperature, the first hull may have an expansion along its longitudinal axis, which is different compared to the load-supporting structure 4.

Additionally or alternatively, the bearing load may be caused by changing mechanical loads. Such changing mechanical loads may be caused by water waves, which cause torsion of the vessel.

In the described exemplary embodiment, the stem side beam 10 is connected to the hull 2 via the compensating connections 20 and 21 and the stem side beam 11 is connected to the hull 3 via the compensating connections 22 and 23. Over each of the compensating connections 20, 21, 22 and 23, a portion of a vertical load of the load-supporting structure 4 and the transportation load is transmitted.

Figure 3:
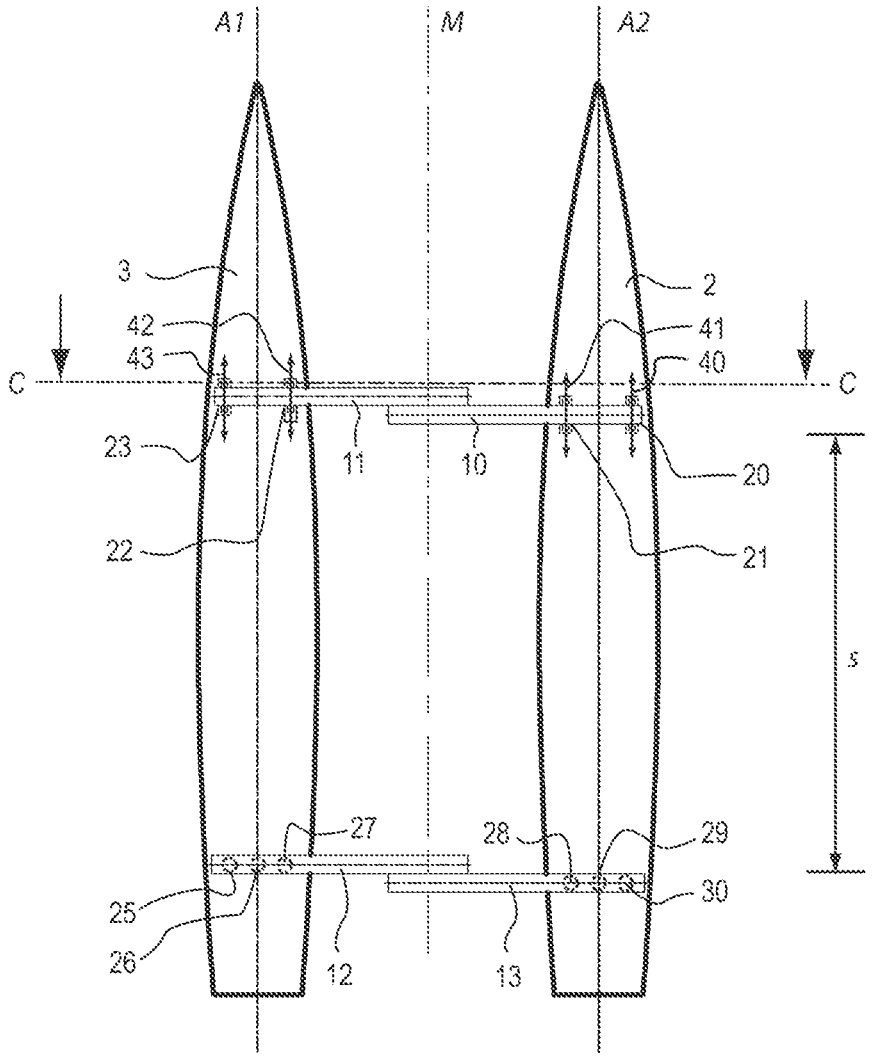
FIG. 3 is a top view of the beams, the hulls and the fixation between the beams and the hulls of the embodiment, which is shown in FIG. 1.

FIG. 3 is a top view of the beams 10, 11, 12 and 13, the hulls 2 and 3, and the connection between the beams 10, 11, 12 and 13 and the hulls 2 and 3. For simplicity of illustration, in particular the load-supporting structure 4 (shown in FIGS. 2A and 2B) and the linear bearings, which connect the beams 10, 11, 12 and 13 to the load-supporting structure 4 are not depicted. For clarification of illustration, in FIG. 3, the section line C-C for the cross-sectional views of FIGS. 2A and 2B is shown.

Each of the compensating connections 20, 21, 22 and 23 includes exactly one degree of freedom, which is a translational degree of freedom. For each of the compensating connections, the translational degree of freedom is oriented along the longitudinal axis A1, A2 of the hull, to which the respective compensating connection provides a connection.

In FIG. 3, for each of the compensating connections, the degree of freedom is illustrated by an arrow 40, 41, 42 and 43.

It has been shown that each of the degrees of freedom 40, 41, 42 and 43 reduces the bearing load on at least one of the displacement bearings. At each of the compensating connections 20, 21, 22 and 23, a relative movement between the beam and the hull, which is performed along the degree of freedom, leads to a change of a bearing load of at least one of the displacement bearings.

Each of the compensating connections 20, 21, 22 and 23 transmits a portion of the force for changing the position of the hulls 2, 3.

For each of the degrees of freedom 40, 41, 42 and 43, the respective degree of freedom is oriented substantially perpendicular to a direction of travel of the beam, which leads to the compensating connection of the respective degree of freedom. Thereby, the direction of the force transmission, which is performed by the beam, is substantially perpendicular to the degree of freedom. Therefore, each of the compensating connections 20, 21, 22 and 23 blocks or fixes those degrees of freedom, which are used for force transmission at the respective compensating connection. Thereby, the degrees of freedom 40, 41, 42 and 43, are substantially not involved in the changing of the position of the hulls 2 and 3.

The degrees of freedom 40 and 41 of the compensating connections 20 and 21 between the beam 10 and the hull 2 are oriented along the longitudinal axis A2 of the hull 2. The degrees of freedom 42 and 43 of the compensating connections 22 and 23 between the beam 11 and the hull 3 are oriented along the longitudinal axis A1 of the hull 3. It has been shown that this is effective in compensating differences in expansions of the hulls 2, 3 and/or of the components of the load-supporting structure. By way of example, these expansions are thermal expansions. These differences in expansion thereby do not lead to an increase in the bearing load of the displacement bearing. Furthermore, it has been shown that the compensating connections 20, 21, 22 and 23 can reduce the influence of changing loads on the bearing load. The changing loads may be, for example, caused by wave movements.

The stern side beam 12 is connected to the hull 3 via a plurality of fixing connections 25, 26, 27. Also, the stern side beam 13 is connected to the hull 2 via a plurality of fixing connections 28, 29, 30. Each of the fixing connections fixes at least all three translational degrees of freedom.

By way of example, each of the fixing connections 25, 26, 27, 28, 29, 30 is configured as a screw connection.

For each of the hulls 2 and 3, all fixing connections 25, 26, 27, 28, 29 and 30 are axially separated from all compensating connections 20, 21, 22, 23. In other words, there is a separation distance s between the compensating connections 20, 21, 22, 23 and the fixing connections 25, 26, 27, 28, 29 and 30. The separation distance s may be greater than one-quarter, greater than one-third or greater than one-half of the axial length of the respective hull.

The multi-hull vessel further comprises a measurement device (not shown in FIG. 3), which is configured to acquire a position parameter and/or a movement parameter of the position of the first hull relative to the second hull.

In the embodiment, which is shown in FIG. 3, the measurement device is configured to measure a distance dl between the longitudinal axes Al, A2 of the hulls 2, 3 at the stem side end portions of the hulls 2, 3. Furthermore, the measurement device measures a distance d2 between the longitudinal axes Al, A2 at the stern side end portions of the hulls 2, 3. Alternatively, the measurement device may be configured to measure a rate of change of the distances dl and d2.

The multi-hull vessel includes a plurality of drive systems for changing the position of the first hull 2 relative to the second hull 3.

The drive systems are controlled by a control unit (not shown in FIG. 3) depending on the acquired position parameters. Thereby, it is possible that during the changing, the distance dl is substantially identical to the distance d2. It has been shown that thereby, the bearing load of the displacement bearing can be kept low.

Figure 4:
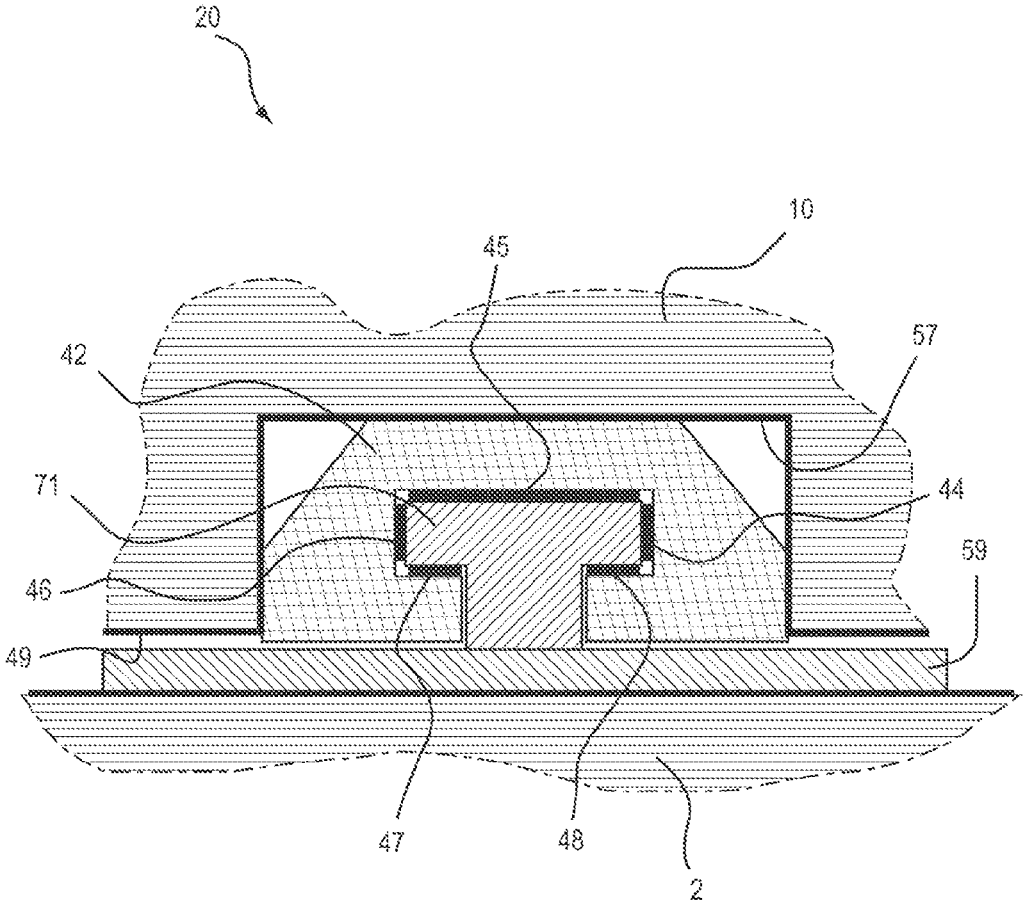
FIG. 4 is a cross-sectional view of a compensating connection according to a first embodiment.

FIG. 4 shows a cross-sectional view through the compensating connection 20 according to a first embodiment. The compensating connection 20 is arranged between the beam 10 and the hull 2. The longitudinal axis of the hull 2 is oriented perpendicular to the paper plane of FIG. 4. The compensating connections 21, 22 and 23 can be configured correspondingly to the compensating connection 20.

The compensating connection 20 is configured as a linear sliding bearing, the degree of freedom of which being oriented along the longitudinal axis of the hull 2, and hence perpendicular to the paper plane of FIG. 4.

The beam 10 includes a tunnel-shaped recess 57 in the ground facing surface 49 of the beam 10. The recess extends along the longitudinal axis of the hull 2. In the recess 57, a carriage 42 is arranged. On the sky facing surface of the hull 2, a base plate 59 is mounted.

On the base plate 59, a rail 71 is attached. The rail has a T-shaped profile. The rail extends in a direction, which is parallel to a longitudinal axis of the hull 2 with a constant profile. On the surfaces of the crossbeam of the T-shaped profile, sliding coatings 44, 45, 46, 47 and 48 are arranged, which engage the sliding surfaces of the carriage 42. By way of example, the sliding coatings 44, 45, 46, 47 and 48 are made at least partially of plastics material.

Figure 5A:
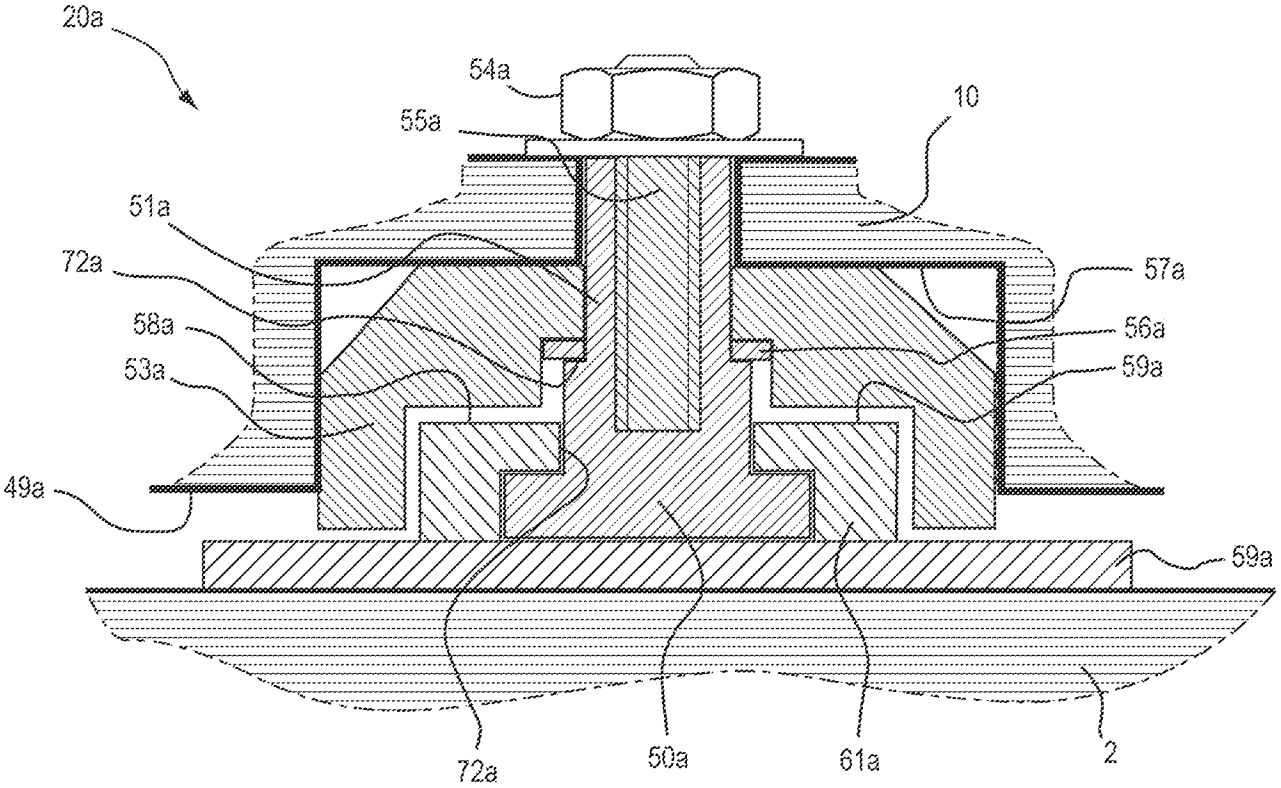
FIG. 5A is a cross-sectional view through a compensating connection according to a second embodiment.

FIG. 5A shows a compensating connection 28 according to a second embodiment.

The second embodiment of a compensating connection, which is shown in FIG. 5A, includes components, which are corresponding in structure and/or function to components of the first exemplary embodiment 20, which is shown in FIG. 4. Therefore, a portion of the components of the second embodiment have been given the same numeral designation with the addition of the letter "a".

The compensating connection 20*a* includes a sliding element 50*a* as a bearing element, which is moveably guided on a rail, which functions as a bearing element. The rail is formed by the ground plate 59*a* and a structure 61*a* and has a C-shaped profile. In the interior of the C-shaped profile, bearing surfaces are arranged on which the sliding surfaces of the sliding element 50*a* slide. The sliding element 50*a* includes a foot portion, which is arranged in an interior of the rail. Further, the sliding element 50*a* includes an extending portion 51*a* which extends away from the foot portion and includes a threaded hole. In the threaded hole of the extending portion 51*a*, a bolt 55*a* is arrangeable through which the sliding element 60*a* is attachable to the beam 10. The bolt 55*a* and a portion of the extending portion 51*a* are arrangeable in an opening of the beam 10 and can be fixed to the beam 10 by means of a nut 54*a*.

The extending portion 51*a* includes a shoulder 58a, which supports a collar element 56*a*. The collar element 56*a* in turn supports a stabilizing element 53*a* via which the extending portion 51*a* and the beam 10 are positively locked. The positive-lock connection blocks or fixes two translational degrees of freedom, which are oriented orthogonal to the translational degree of freedom of the compensating connection. Through the stabilizing element 53*a*, a higher degree of stability is obtained along the two blocked or fixed translational the degrees of freedom. Furthermore, the stabilizing element 53*a* allows for a force transmission to the beam 10 via a greater surface area.

Figures 5B, 5C:
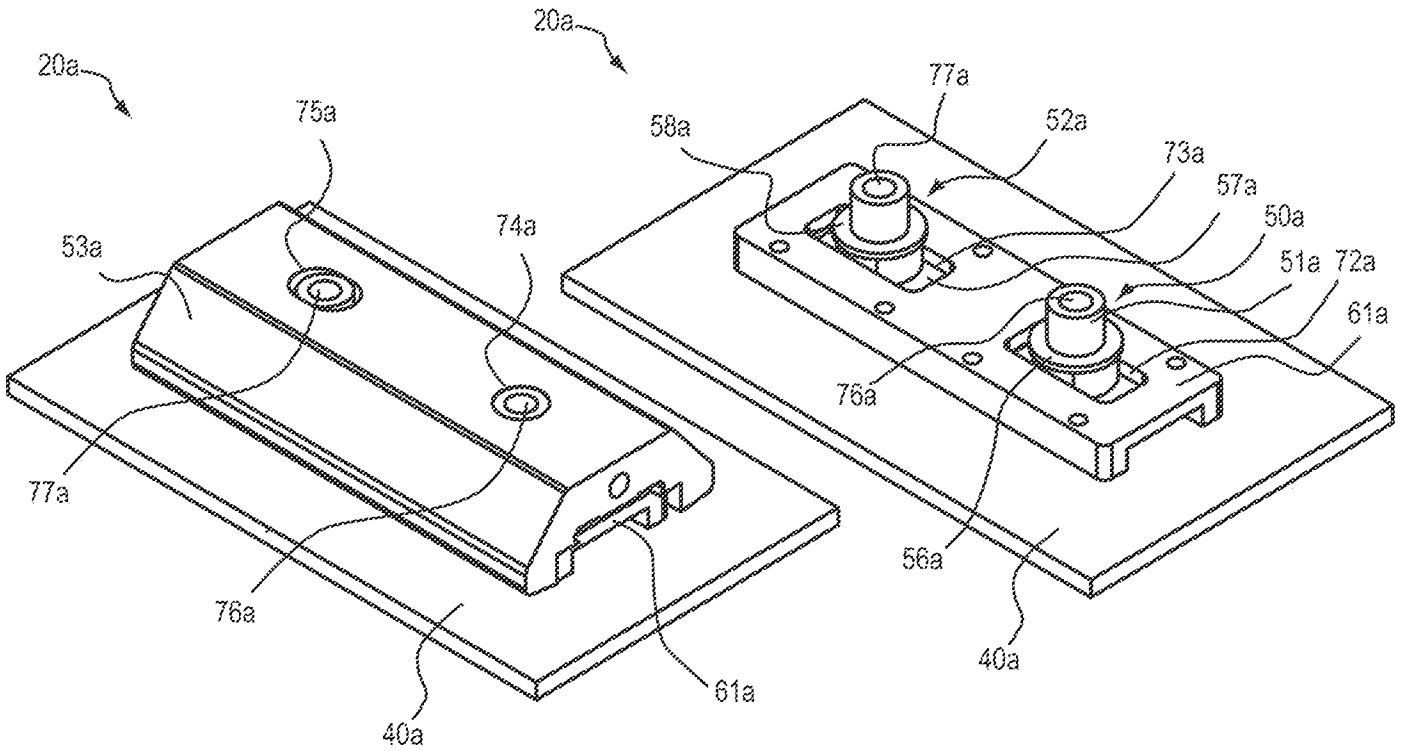
FIG. 5B is a perspective view of the compensating connection according to the second embodiment.
FIG. 5C is a further perspective view of the compensating connection according to the second embodiment.

Each of FIGS. 5B and 5C is a perspective illustration of the compensating connection 20*a*. In FIG. 5B, the compensating connection 20*a* is illustrated together with the stabilizing element 53*a*, whereas in FIG. 5C, the compensating connection 20*a* is illustrated without the stabilizing element 53*a*. For simplicity of illustration, in FIGS. 5B and 5C, the beam 10 is not shown.

As can be seen from FIGS. 5B and 5C, the compensating connection 20*a* further has a second sliding element 52*a* as a bearing element, which is arranged displaced relative to the first sliding element 50*a*, as viewed along a direction, which is parallel to the longitudinal axis of the hull 2.

The second sliding element 52*a* is configured to be substantially identical to the first sliding element 50*a*. The second sliding element 52*a* is connectable to the beam 10 via a bolt (which is not illustrated in FIGS. 5B and 5C) in a same manner as the first sliding element 50*a*. The second sliding element 52*a* slides on a rail as counter-bearing element formed by the base plate 59*a* and the structure 61*a*.

As can be seen in FIG. 5C, the structure 61*a* has a first slot 72*a* and a second slot 73*a*. Each of the slots 72*a*, 73*a* is configured so that the base plate 59*a* and the structure 61*a* together form a C-profile for guiding the first sliding element 50*a* and the second sliding element 52*a*. The first sliding element 50*a* extends through the first slot 72*a* and the second sliding element 52*a* extends through the second slot 73*a*. The stabilizing element 53*a* has a first opening 74*a* through which the first sliding element 50*a* at least partially extends. Further, the stabilizing element 53*a* has a second opening 75*a*, through which the second sliding element 52*a* at least partially extends. Thereby, the stabilizing elements stabilizes at least two sliding elements 50*a*, 52*a*.

Figure 6A:
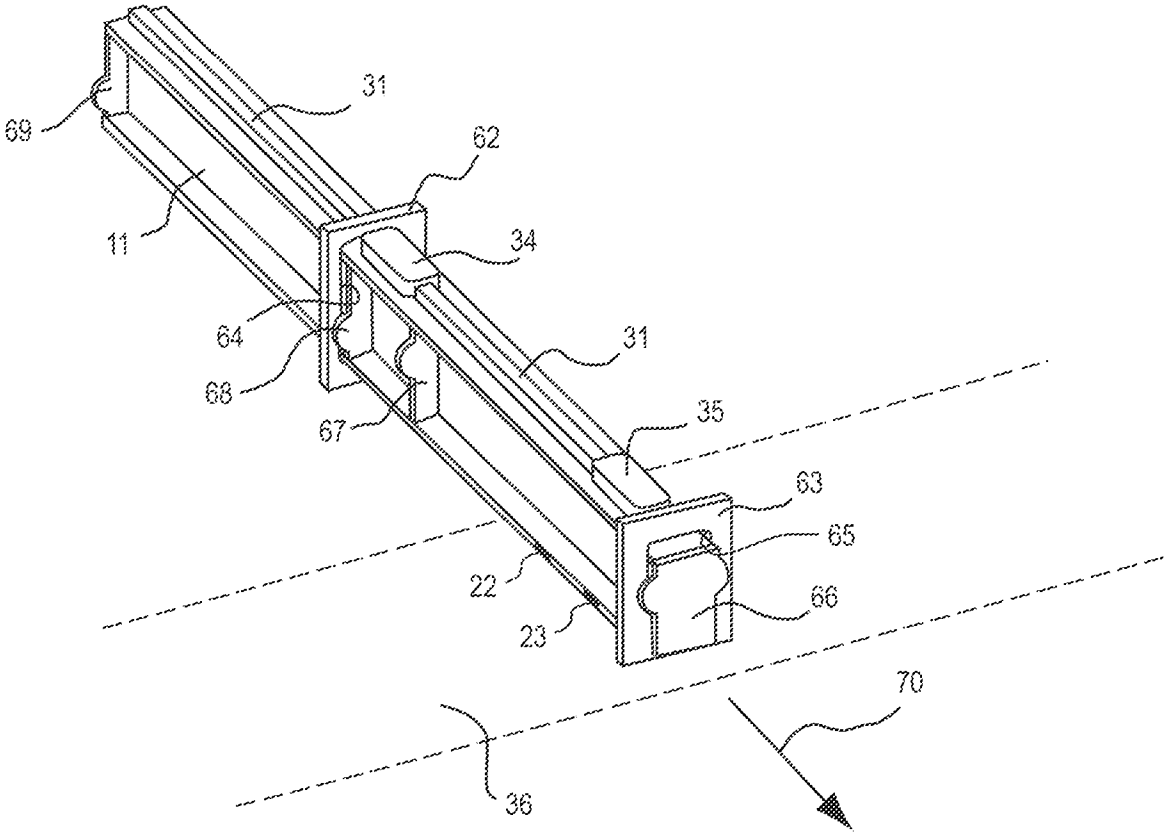
FIG. 6A is a perspective view of a fixation device for fixing a beam relative to the load-supporting structure in the embodiment which is shown in FIG. 1 when the multi-hull vessel is in the second configuration.

As is explained in the following with reference to FIGS. 6A and 6B, the multi-hull vessel 1 has a supporting device. The supporting device is configured so that a mechanical bypass of the displacement bearing is activatable. Via the mechanical bypass, at least a portion of the bearing load of the displacement bearing is transmitted. This is illustrated in FIG. 6A for the stem side beam 11. For the remaining beams 10, 12 and 13, the supporting device is configured correspondingly.

As can be seen in FIG. 6A, the beam 11 is configured as an I-beam. On the I-beam, a linear bearing rail 31 is arranged, which extends substantially along the entire length of the beam 11. On the rail 31, carriages 34 and 35 of the linear bearing are arranged, which are connected to the load-supporting structure 4 (shown in FIGS. 2A and 2B). The carriages 34 and 35 and the rail 31 together form a displacement bearing. The displacement bearing together with the displacement bearings, which are arranged at the remaining beams, form a bearing for the change of the position of the hulls relative to each other. As is also shown in FIG. 6A, the beam 11 is connected to the surface 36 of the hull 3 via compensating connections 22 and 23 (also illustrated in FIGS. 1, 2A and 2B).

The load-supporting structure 4 includes a first frame 62 and a second frame 63. The second frame 63 is open at the bottom. The beam 11 and the rail 31, which is mounted on the beam 11, extend through the opening 64 of the first frame 62 and through the opening 65 of the second frame 63. The first frame 62 is arranged substantially in the center of the multi-hull vessel. As is shown in FIG. 1, the second frame 63 is arranged on an outer side of the load-supporting structure 4, at which the beam 11 extends from the load-supporting structure 4.

The beam 11 has a first end plate 66 at a first end thereof and a second end plate 69 at a second end thereof. Furthermore, the beam 11 has on a side, which is shown in FIG. 6A a first rib 68 and a second rib 67. At the opposing side, which is not illustrated in FIG. 6A, the beam 11 has a rib, which corresponds to the rib 68 and which has a same axial position as the first rib 68. Further, on the opposing side, the beam 11 has a rib, which corresponds to the second rib 67 and which has a same axial position, as the second rib 67.

FIG. 6A shows the beam 11, when the catamaran is in the second configuration (shown in FIG. 2B), in which the hulls are retracted. In this configuration, the first end plate 66 abuts against the second frame 63. Furthermore, the first rib 68 and the rib, which corresponds to the first rib 68 abut against the first frame 62. The first frame 62 has two bolts (not shown), which, in the second configuration, extend through corresponding openings (not shown) of the first rib 68 and of the rib, which corresponds to the first rib 68. Furthermore, the second frame 63 includes two bolts (not shown), which, in the second configuration, extend through corresponding openings (not shown) provided in the first end plate 66. Each of the bolts is oriented along the longitudinal axis of the beam 11, so that by displacing the beam in a direction parallel to its longitudinal axis, the bolts can be inserted through the openings or the bolts can be retracted from the openings.

With the bolts extending through the openings, an additional positive locking connection is provided, which connects the load-supporting structure to the beam 11. The positive locking connection is a connection, which is provided additionally to the connection between the load-supporting structure and the beam 11 via the displacement bearing. This additional connection which is a positive locking connection supports the bearing load of the displacement bearing. The displacement bearing thereby is mechanically bypassed. The mechanical bypass is activated, when the catamaran is brought into the second configuration and the bolts extend through their corresponding openings.

If the catamaran is converted from the second configuration (shown in FIG. 2B) into the first configuration (shown in FIG. 2A), the beam 11 moves along the direction of arrow 70. The position of the beam 11 relative to the first and the second frame 62, 63 according to the first configuration is illustrated in FIG. 6B.

By moving the beam 11 out of the second configuration, the first rib 66, the rib which corresponds to the first rib 68 and the first end plate 66 are moved out of abutment and the bolts of the first and the second frames 62, 63 are retracted from their corresponding openings. Thereby, the mechanical bypass is the deactivated.

Figure 6B:
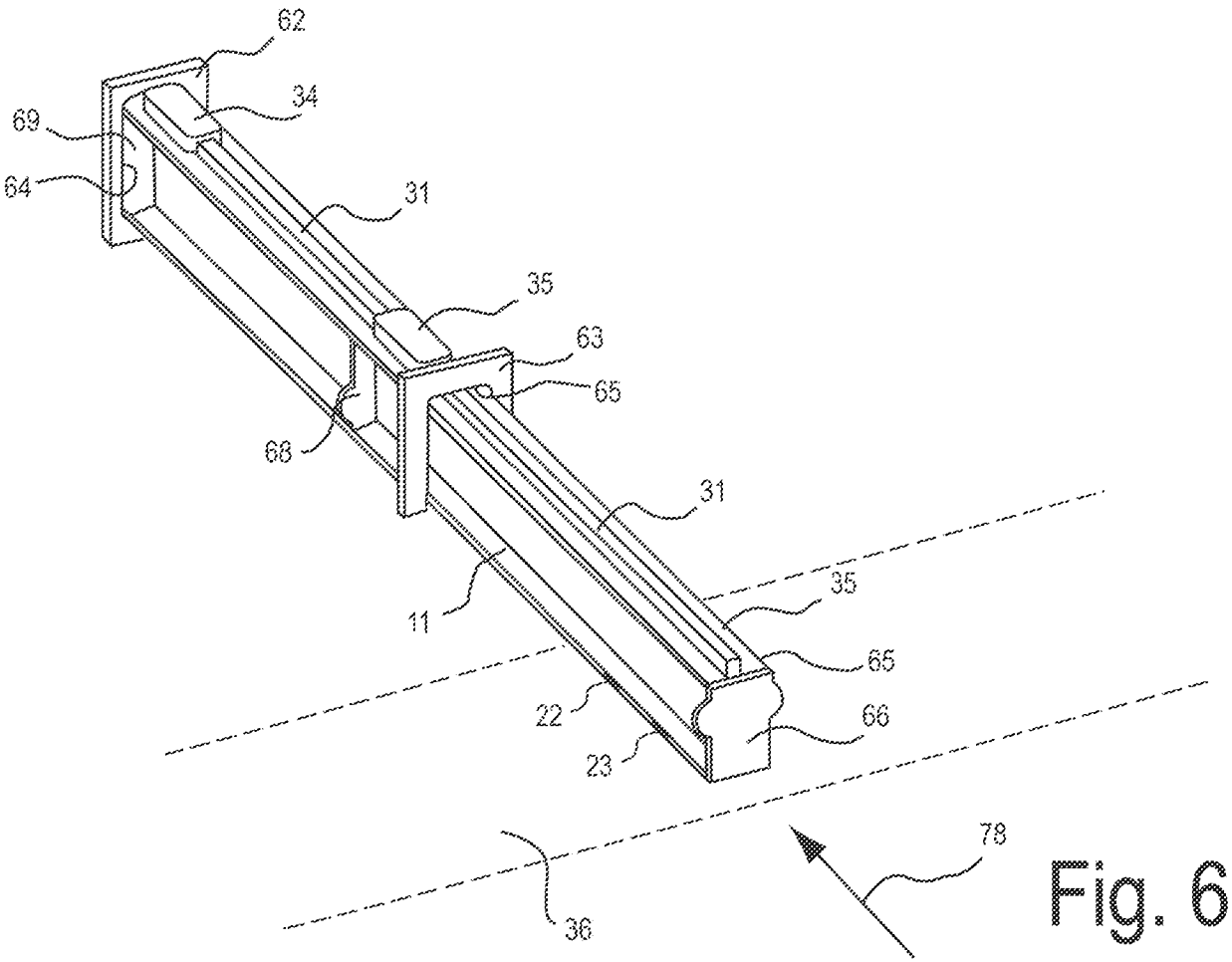
FIG. 6B is a further perspective view of the fixation device when the multi-hull vessel is in the first configuration.

As is shown in FIG. 6B, in the first configuration, the second end plate 69 abuts against the first frame 62. In FIG. 6B, the second rib 67 is hidden by the second frame 63, since the second rib and the rib which corresponds to the second rib abut against the second frame 63.

The second frame 63 includes two bolts, which, in the first configuration, extend through corresponding openings provided in the second rib 67 and in the rib which corresponds to the second rib 67. Furthermore, the first frame 62 includes two bolts, which, in the first configuration, extend through corresponding openings provided in the second end plate 69. Each of the bolts is aligned along the longitudinal axis of the beam.

With the bolts extending through the openings, an additional form locking connection is provided also in the first configuration, which connects the load-supporting structure to the beam 11. This positive locking connection is additional to the connection between the load-supporting structure and the beam 11 via the displacement bearing. This additional connection, which is a form locking connection, supports the bearing load of the displacement bearing. Thereby, the displacement bearing is mechanically bypassed. The mechanical bypass is activated, when the catamaran is converted into the first configuration.

The mechanical bypass which is provided by the bolts, which extend through the openings, is in particular made possible by the compensating connections 20, 21, 22, 23. These compensating connections are in particular configured to compensate for differences in expansion between components of the catamaran. Furthermore, these compensating connections are configured to compensate for a changing mechanical load, which is caused by breaking of the waves.

Thereby, a multi-hull vessel is obtained, which efficiently provides a high degree of stability in the first and in the second consideration.

Figure 7:
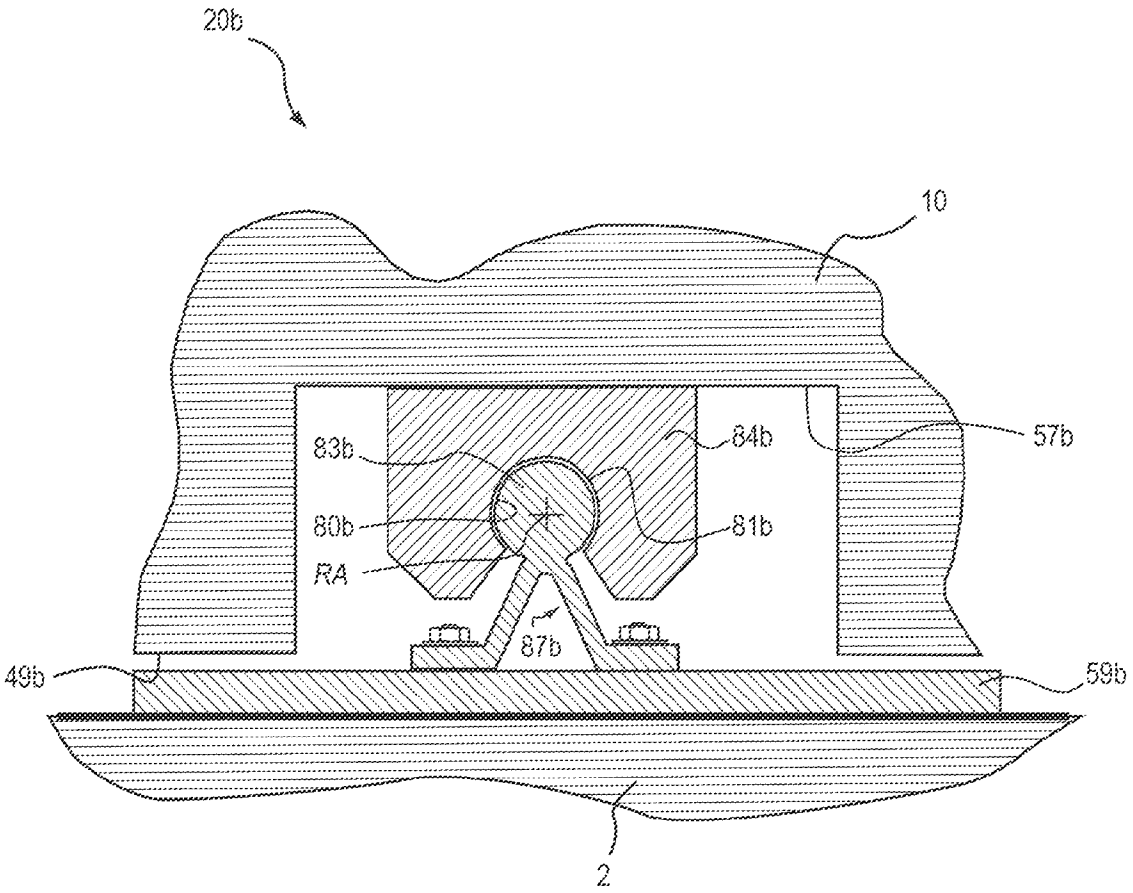
FIG. 7 is a cross-sectional view through a compensating connection according to a third embodiment.

FIG. 7 shows a compensating connection 20*b* according to a third exemplary embodiment. The compensating connection 20*b* includes components, which are corresponding in structure and/or function to components of the first and the second exemplary embodiments 20 and 20A, which are shown in FIGS. 4 and 5A. Therefore, a portion of the components of the third embodiment have been given the same numeral designation with the addition of the letter "b".

The compensating connection 20*b* includes a convex surface 80*b* and a concave surface 81*b*. The convex surface 80*b* engages with the concave surface 81*b*. The convex surface 80*b* and the concave surface 81*b* are configured so that the compensating connection 20*b* has a swingable connection. The convex surface 80*b* may have sliding contact with the concave surface 81*b*. Alternatively or additionally, it is conceivable that each of the convex surface 80*b* and the concave surface 81*b* have raceway surfaces for rollers of the compensating connection, which are not shown in FIG. 7. The concave surface 81*b* may slidingly engage with the convex surface 80*b* and/or may engage the convex surface via rollers.

The swingable connection is configured so that a bearing housing 84*b* of the compensating connection 20*b* is swingable relative to a shaft 83*b* of the compensating connection 20*b*. The bearing housing 84*b* is rigidly connected to the beam 10. The shaft 83 is connected to the first hull 2 via a carrier 87*b* and a base plate 59*b*. Alternatively, it is also conceivable that the compensating connection 20*b* is configured so that the bearing housing 84 is rigidly connected to the hull 2 and the shaft 83*b* is rigidly connected to the beam 10. Thereby, the compensating connection allows for a swinging movement of the a connection element of the compensating connection 20*b* relative to a second connection element of the compensating connection 20*b*. The first connection element is provided by the shaft 83*b*, whereas the second connection element is provided by the bearing housing 84*b*.

The swinging connection of the compensating connection 20*b* is configured as a radial bearing. The radial bearing is configured as a sliding bearing. However, it is also conceivable that the radial bearing is configured as a roller bearing. A rotational axis RA of the radial bearing is oriented perpendicular to the paper plane of FIG. 7. This corresponds to a direction, which is parallel to a longitudinal axis of the first hull 2. The rotational axis RA thereby represents a swing axis of the swingable connection.

It has been shown that as a result of the configuration of the compensating connection according to the third embodiment, a more reliable device for changing the position and/or orientation of the hulls relative to each other can be obtained. In particular, it has been shown that thereby, torsional forces during the changing of the position and/or orientation of the first hull relative to the second hull can be better absorbed. Thereby the risk of jamming of the displacement bearing can be lowered and wear of the bearing can be significantly reduced.

The compensating connection 20*b* is further configured so that the bearing housing 84*b* is axially displaceable along the longitudinal axis of the shaft 83*b*. Thereby, a translational degree of freedom of the compensating connection 20*b* is provided, which is oriented parallel to the longitudinal axis of the first hull and parallel to the rotational axis RA of the radial bearing. The bearing housing 84*b* and the shaft 83*b* thereby are moveable relative to each other in a direction along or parallel to the translational degree of freedom.

In the compensating connection 20*b*, the bearing housing 84*b* partially surrounds the shaft 83*b*. Thereby, it is possible that the shaft 83*b* is supported by the carrier 87*b* along a longitudinal portion of the shaft 83*b*, which corresponds to the axial range of travel of the bearing housing 84*b*. Thereby, it is possible to transmit a comparatively large portion of the vertical load without deflecting the shaft. Alternatively, however, it is also conceivable that the bearing housing is closed and the shaft 83*b* is supported at axial positions relative to the rotational axis RA, which are located outside of the travel range of the bearing housing 84*b*.

In the illustrated exemplary embodiment, the shaft has a diameter, which is larger than 20 millimeters, or larger than 30 millimeters, or larger than 40 millimeters. The diameter may be smaller than 200 millimeters or smaller than 100 millimeters.

The invention claimed is:

1. A multi-hull vessel, comprising a first hull and a second hull; and a connecting structure, via which the first hull is connected to the second hull;

wherein the connecting structure comprises beams oriented transversely to a longitudinal axis of the multi-hull vessel, each of the beams having a linear displacement bearing for at least partially guiding a linear change of a position and/or an orientation of the first hull relative to the second hull;

wherein the connecting structure is configured so that the displacement bearing is connected to at least a portion of the first hull via a compensating connection;

wherein the compensating connection comprises one or more degrees of freedom for reducing a bearing load of the displacement bearing.

2. The multi-hull vessel according to claim 1, wherein the multi-hull vessel comprises one or more drive systems for the changing the position and/or the orientation of the first hull relative to the second hull, wherein through the changing of the position and/or the orientation, a distance between the first hull and the second hull is variable for varying a width of the multi-hull vessel.

3. The multi-hull vessel according to claim 2, wherein the compensating connection comprises a translational degree of freedom.

4. The multi-hull vessel according to claim 3, wherein the translational degree of freedom is the only translational degree of freedom of the compensating connection.

5. The multi-hull vessel according to claim 4, wherein the compensating connection (20) is configured to compensate for a difference in expansion between an expansion of the first hull along a longitudinal axis of the first hull and an expansion of the connecting structure using the translational degree of freedom.

6. The multi-hull vessel according to claim 4, wherein the compensating connection is configured to compensate for differences in extension between components of the multi-hull vessel.

7. The multi-hull vessel according to claim 4, wherein an angle between the translational degree of freedom and an axis, which is parallel to a longitudinal axis of the first hull, is less than 45 degrees, or less than 30 degrees, or less than 20 degrees, or less than 10 degrees, or less than 5 degrees.

8. The multi-hull vessel according to claim 4, wherein the translational degree of freedom is oriented substantially parallel to a longitudinal axis of the first hull.

9. The multi-hull vessel according to claim 8, wherein the translational degree of freedom is guided.

10. The multi-hull vessel according to claim 8, wherein the translational degree of freedom is provided by a linear bearing.

11. The multi-hull vessel according to claim 10, wherein the compensating connection comprises a radial bearing.

12. The multi-hull vessel according to claim 11, wherein the radial bearing comprises a shaft and a bearing housing, wherein the shaft and the bearing housing are displaceable relative to each other along a longitudinal axis of the shaft.

13. The multi-hull vessel according to claim 12, wherein the translational degree of freedom of the compensating connection is provided by the displaceability.

14. The multi-hull vessel according to claim 8, wherein the compensating connection is configured to transmit at least a portion of a force for changing the position and/or the orientation of the first hull relative to the second hull.

15. The multi-hull vessel according to claim 8, wherein the compensating connection comprises a swingable connection, wherein the swingable connection is configured for swinging a first connection element of the swingable connection relative to a second connection element of the swingable connection.

16. The multi-hull vessel according to claim 15, wherein the first connection element is rigidly connected to at least a portion of the first hull or is integrally formed with at least a portion of the first hull; and wherein the second connection element is rigidly connected to at least a portion of the connecting structure or integrally formed with at least a portion of the connecting structure.

17. The multi-hull vessel according to claim 16, wherein the swingable connection is further configured so that the first connection element is swingable relative to the second connection element through an angle, of at least 1 degree, or at least 5 degrees, or at least 10 degrees, or at least 20 degrees.

18. The multi-hull vessel according to claim 8, wherein the compensating connection further comprises a rotational degree of freedom, wherein a rotational axis of the rotational degree of freedom is oriented substantially parallel to the translational degree of freedom.

19. The multi-hull vessel according to claim 8, wherein the compensating connection further comprises a rotational degree of freedom, wherein an angle between the translational degree of freedom and an axis, which is parallel to a rotational axis of the rotational degree of freedom, is less than 45 degrees, or less than the 30 degrees, or less than 20 degrees, or less than 10 degrees, or less than 5 degrees.

20. A multi-hull vessel comprising:

a first hull and a second hull; and a connecting structure, via which the first hull is connected to the second hull;

wherein the connecting structure comprises a linear displacement bearing for at least partially guiding a linear change of a position and/or an orientation of the first hull relative to the second hull;

wherein the connecting structure is configured so that the displacement bearing is connected to at least a portion of the first hull via a compensating connection;

wherein the compensating connection comprises one or more degrees of freedom for reducing a bearing load of the displacement bearing; and wherein the compensating connection comprises a rotational degree of freedom, wherein an angle between a rotational axis of the rotational degree of freedom and an axis, which extends parallel to a longitudinal axis of the first hull, is less than 45 degrees, or less than 30 degrees, or less than 20 degrees, or less than 10 degrees, or less than 5 degrees.

21. The multi-hull vessel according to claim 1, wherein the compensating connection comprises a rotational degree of freedom, wherein an axis of the rotational degree of freedom extends substantially parallel to a longitudinal axis of the first hull.

22. The multi-hull vessel according to claim 1, wherein the degree of freedom of the compensating connection is configured to allow for a relative movement of more than 5 millimeters.

23. A multi-hull vessel comprising:

a first hull and a second hull; and a connecting structure, via which the first hull is connected to the second hull;

wherein the connecting structure comprises a linear displacement bearing for at least partially guiding a linear change of a position and/or an orientation of the first hull relative to the second hull;

wherein the connecting structure is configured so that the displacement bearing is connected to at least a portion of the first hull via a compensating connection;

wherein the compensating connection comprises one or more degrees of freedom for reducing a bearing load of the displacement bearing;

wherein the multi-hull vessel comprises one or more drive systems for the changing the position and/or the orientation of the first hull relative to the second hull, wherein through the changing of the position and/or the orientation, a distance between the first hull and the second hull is variable for varying a width of the multi-hull vessel, wherein the compensating connection comprises a translational degree of freedom, and wherein the compensating connection comprises an elastomeric connection element.

24. The multi-hull vessel according to claim 10, wherein:

the displacement bearing comprises a linear bearing;

through the changing of the position and/or orientation, a distance between the first hull and the second hull is variable for varying a width of the multi-hull vessel; and wherein the connecting structure further comprises:

a force-transmitting component configured for a force transmission to the first hull for performing the changing of the position and/or the orientation of the first hull relative to the second hull; and a load supporting structure, wherein a connection between the load-supporting structure and the force-transmitting component is a movable connection, which comprises the displacement bearing;

wherein the compensating connection is arranged at a transition between the force-transmitting component and the first hull.

25. The multi-hull vessel according to claim 11, wherein:

the displacement bearing comprises a linear bearing;

through the changing of the position and/or orientation, a distance between the first hull and the second hull is variable for varying a width of the multi-hull vessel; and wherein the connecting structure further comprises:

a force-transmitting component configured for a force transmission to the first hull for performing the changing of the position and/or the orientation of the first hull relative to the second hull; and a load supporting structure, wherein a connection between the load-supporting structure and the force-transmitting component is a movable connection, which comprises the displacement bearing;

wherein the compensating connection is arranged at a transition between the force-transmitting component and the first hull.

* * * * *